US005085168A

United States Patent [19]

Sollinger

[11] Patent Number: 5,085,168

[45] Date of Patent: Feb. 4, 1992

[54] DEVICE FOR COATING WEB MATERIAL

[75] Inventor: Hans-Peter Sollinger, Heidenheim, Fed. Rep. of Germany

[73] Assignee: J. M. Voith GmbH, Heidenheim, Fed. Rep. of Germany

[21] Appl. No.: 537,573

[22] Filed: Jun. 14, 1990

[30] Foreign Application Priority Data

Jun. 22, 1989 [DE] Fed. Rep. of Germany ..... 3920445
Mar. 16, 1990 [DE] Fed. Rep. of Germany ..... 4008435

[51] Int. Cl.[5] ..... B05C 11/04
[52] U.S. Cl. ..... 118/126; 118/261; 118/413; 118/623
[58] Field of Search ..... 118/110, 118, 119, 123, 118/126, 419, 413, 623, 639, 122, 261; 427/47

[56] References Cited

U.S. PATENT DOCUMENTS

| | | | |
|---|---|---|---|
| 3,688,336 | 9/1972 | Costello, Jr. et al. | 118/126 |
| 3,882,817 | 5/1975 | Zink | 118/126 |
| 4,553,498 | 11/1985 | Sommer | 118/261 |
| 4,880,672 | 11/1989 | Ericksson | 118/126 |
| 4,943,451 | 7/1990 | Zimmer | 118/413 |
| 4,993,352 | 2/1991 | Zimmer | 118/126 |

*Primary Examiner*—Jay H. Woo
*Assistant Examiner*—Khanh P. Nguyen
*Attorney, Agent, or Firm*—Baker & Daniels

[57] ABSTRACT

In a coating device, a doctor blade is bent S-shaped for application of its contact force by means of a pressure bar. An additional force of a profile correction device is exerted for profile correction by means of magnets. This additional force acts preferably opposite to the main contact force. This prevents the profile correction device from causing a change of the geometry of the doctor blade in the contact area of the spreading edge of the doctor blade.

16 Claims, 2 Drawing Sheets

DEVICE FOR COATING WEB MATERIAL

BACKGROUND OF THE INVENTION

The invention concerns a coating device for the coating of running webs, specifically of paper and cardboard, of the type wherein the coating device includes a doctor in the form of a blade which is mounted and supported on a doctor beam, in which the contact force of the doctor blade is applied through its deflection for the coating of the paper or cardboard web. Such devices are frequently known, for instance from the German patent document No. 35 30 063.

Pressure hoses are frequently used on coating devices, for application of pressure forces. For one, pressure hoses make it possible to clamp a doctor fashioned as a doctor blade in the holder and, for another, to also exert pressures on the doctor for controlling the thickness of the coating applied on the paper. According to the aforementioned document, slat type pressure components, among others, are used to control the thickness of the coating application, which components are screw-adjustable against the doctor blade, thus controlling their contact force. This permits controlling the so-called cross profile of the coating application, that is, the width or cross direction of the paper web, in such a way that a maximally uniform coating profile will result, i.e., actually no profile at all, namely a uniform coating thickness.

The process involves the disadvantage that the contact angle $\alpha$ of the narrow edge of the doctor blade varies somewhat on the paper web, due to the local control of the contact force of the doctor blade. This is unfavorable for generating a uniform coating application because it causes disuniform wear of the spreading edge of the doctor blade.

The problem underlying the invention is to provide a device permitting the control of the cross profile of the coating application without the illustrated disadvantageous effects.

SUMMARY OF THE INVENTION

This problem is inventionally solved in a device of the aforementioned type by arranging several magnets in a row parallel to the contact edge of the doctor blade and to apply, for adjusting the profile of the applied coating, magnetic traction forces that act on the bowed section of the doctor blade near the web. By application of the magnetic traction forces on the area of the doctor blade near the web there is nothing changed on the geometry of the coating conditions, on the doctor blade, with regard to the paper web, so that the illustrated disadvantageous effects cannot occur.

There is a prior coating device according to the Austrian patent document No. 386 762 where magnetic forces act on a doctor element that is fashioned as a coating strip. The doctor element is a constituent part of a larger setup that features also the supply chamber for the coating substance and is mounted in swinging fashion so that it will essentially float on the paper web or the coating substance applied on it. The coating strip has a contour which essentially corresponds to the backing roll that supports the paper web or to the path of the paper web resulting from the way it is passed over the backing roll while partially looping around it. What matters here is not an unchangeability of the position of the doctor element with regard to the paper web but, rather, the coating effect is brought about here exactly through a shifting of the coating strip along with the entire coating setup comprising said strip. This leaves open, though, in what way the exact coordination of individual components or their geometric design is to be effected in order to realize the intended coating result. Additionally, there is only a magnetizable, very rigid strip provided here which obviously is to be attracted as a whole by a uniform magnet arrangement. A subdivision into several individual magnets is not provided for because, due to the rigid design of the doctor element or the entire doctor device, such would be without any effect.

BRIEF DESCRIPTION OF THE DRAWINGS

The above mentioned and other features and objects of this invention, and the manner of attaining them, will become more apparent and the invention will be better understood by reference to the following description of embodiments of the invention taken in conjunction with the accompanying drawings, wherein.

Corresponding reference carriers indicate corresponding parts in each view. The exemplifications set out herein illustrates a preferred embodiment of the invention, and such exemplification is not to be construed as limiting the scope of the invention in any manner.

DESCRIPTION OF THE PREFERRED EMBODIMENT

Figure 1:
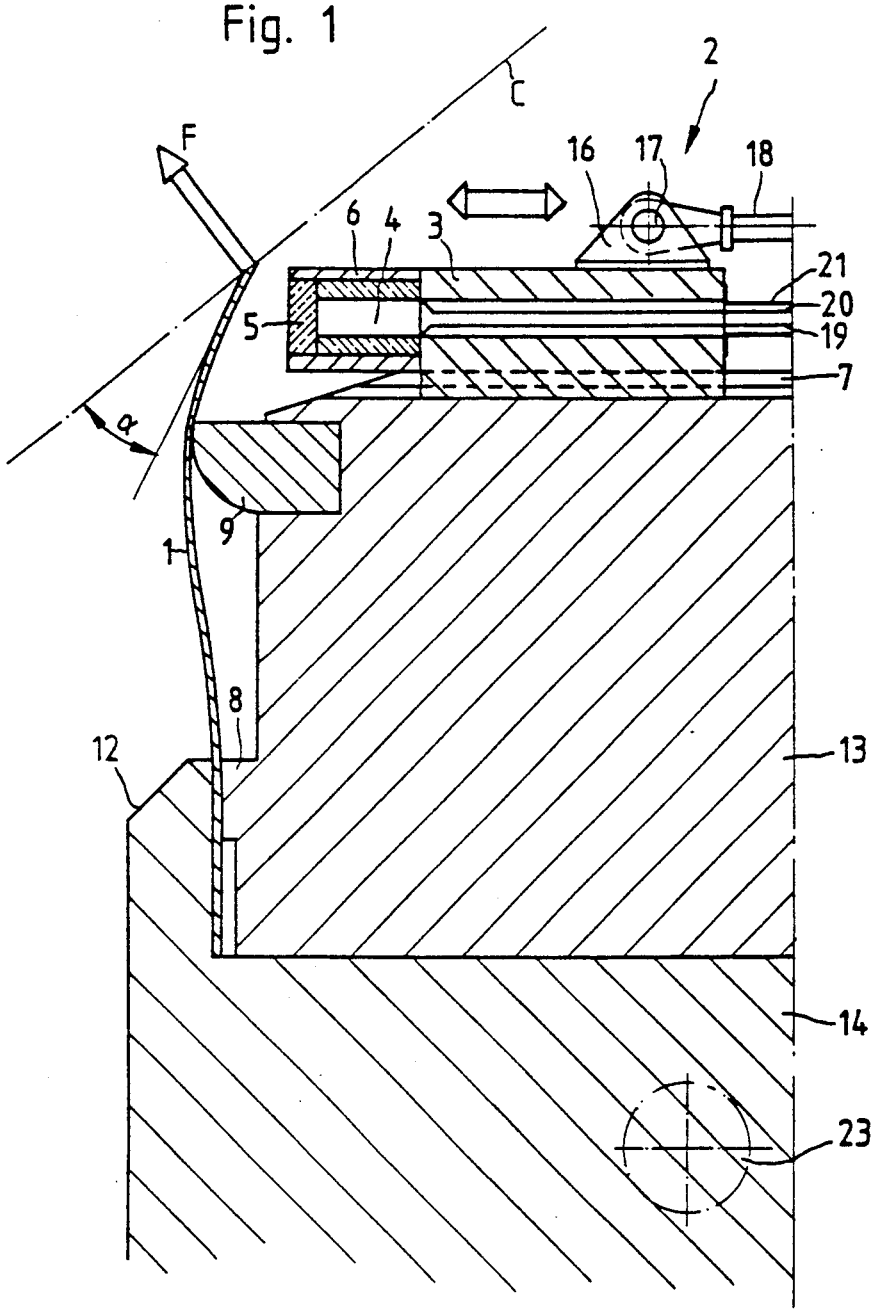
FIG. 1 shows, in principle, a cross section of a coating device.

Referring now to the drawings, and particularly to FIG. 1, marked C is the web, on which bears the doctor blade 1 at a contact pressure produced by adjustment of the doctor support beam 13, 14. This contact pressure can be generated, for example, by pivoting the doctor support beam 14 about a pivot axle 23. The blade 1 serving as a doctor is clamped in a holding strip 13 of the doctor beam 14 by way of a pressure component 8 and a backing component 12. A pressure strip 9 serves to generate the necessary contact pressure through an S-shaped bending of the doctor blade. As control device for the cross profile, the invention uses individual solenoids 4, 5 (4 being the coil, 5 the iron core) which by means of a holder sleeve 6 are mounted on a slide 3. The entire profile correction device is marked 2. It comprises additionally a support cam 16 where actuating bars 18 act by means of bolts 17 on the slide 3. The slide is arranged in a guideway 7 of the holding strip 13 so as to be movable against the doctor blade or the paper web.

Figure 1A:
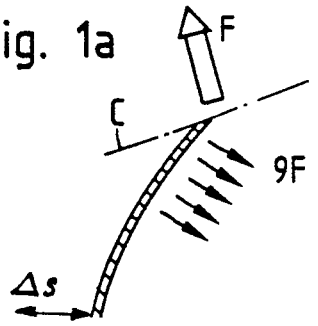
FIG. 1*a* is a force diagram showing the pertaining forces.

The leads to the solenoids are marked 19 and 20 and extend through a cover 21. According to FIG. 1*a*, the solenoids exert locally a sectional load $q_f$ on the area of the doctor blade 1 that is near the paper web or backing roll 10. The solenoids counteract the contact force F, thus controlling the cross profile of the coating application. The basic contact force is generated through the shift $\Delta_5$ by means of the pressure bar 9.

The magnetic induction of the magnets is controlled by way of their coil current in accordance with the locally required contact force of the doctor blade 1.

Figure 2:
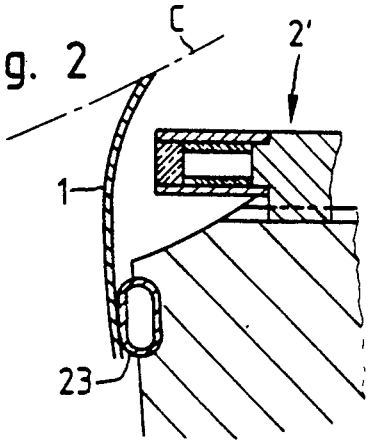
FIG. 2 shows another variant of the inventional coating device.

According to FIG. 2, a permanent magnet 4' may also be used as a magnet, while as the pressure part a hose 24 is suitable, which may serve the same function as the pressure bar 9. However, this is known already from publications.

An exact setting of the individual permanent magnets, in their distance from the doctor blade 1, is effected for controlling its contact force through an infeed of the slide 3. For that purpose, for example, stepping motors may be used which act through a drive on the respective actuating bar 18. Naturally, such can also be performed in the case of the solenoids 4, 5, leaving their induction unchanged.

Since the magnets locally reduce the contact force but have no effect on the geometry of the deformed doctor blade, because they exert a force smaller than the main contact force F, no changes occur in the geometry of the doctor blade, so that an exact coating correction is possible without harmful effects.

In the arrangements described above, a profile correction is accomplished without changing, through the effect of the magnets, the shape and also the position of the doctor blade in any way.

Figure 3:
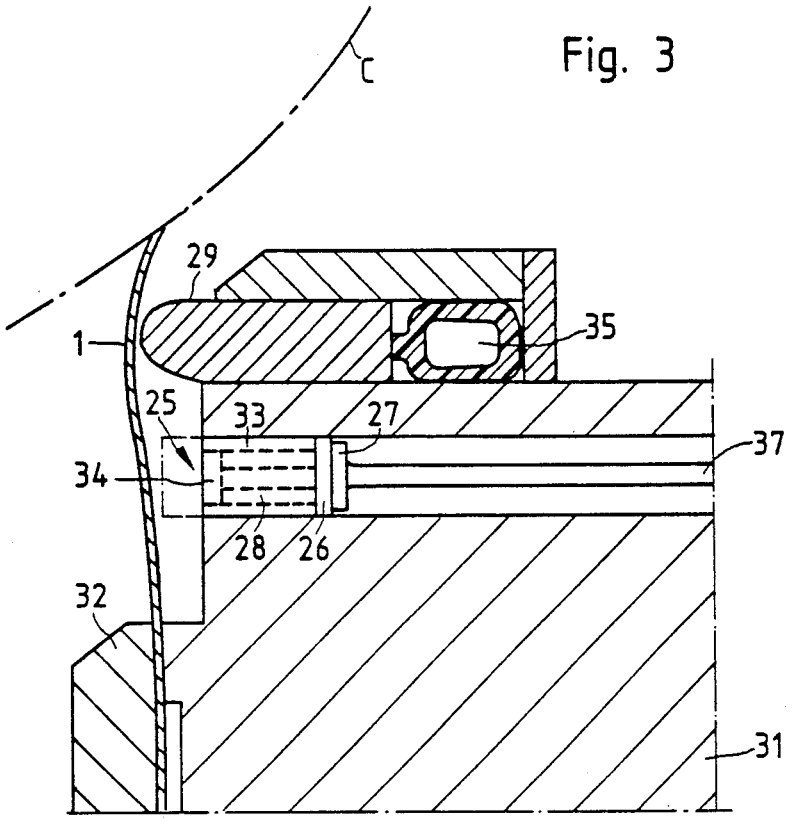
FIG. 3 shows yet another embodiment of the invention.

According to the embodiment relative to FIG. 3 it has bee recognized that also with a somewhat different arrangement, in the bow section of the doctor blade near the backing roll, there occurs only a shape change of the doctor blade so slight that it is negligibly small and will not lead to an irregular coating application. Namely, a basic setting may be effected through the support 29, so that the adjustment of the doctor blade or a change of its geometry, specifically with regard to its contact edge in the profile correction, is extremely small. FIG. 3 will be explained hereafter in more detail.

The doctor blade 1 is mounted on the doctor beam 31 by means of a clamping bar 32. A pressure bar 29 is movable in a guideway 30 for adjustment of a contact force of the doctor blade 1. The drive for the pressure strip is provided here through a pressure hose 35. Naturally, also other drive options are suitable, for instance by means of hydraulic pistons or through linkages and levers.

The profile correction is effected here through individual magnets 25 which are arranged on the doctor beam 31 in a row parallel to the contact edge of the doctor blade 1 and the backing roll C. These magnets may also be solenoids consisting of a yoke plate 34, a sleeve 33 and a wire coil 28 that is contained in it and arranged around an iron core, as illustrated by broken line. The magnets can be adjusted by means of an eccentric plate 27 via a rod 37. The currents of the coils 28 may be adjustable for controlling the field strength of the coils. As a result, the doctor blade 1 is attracted at different degrees in its area opposite the magnets, whereby the contact force of the doctor blade on the backing roll C or the web is distinctly varied. This causes only a slight change of the shape, and thus of the contact edge of the doctor blade. The latter has a shape that is composed of two bow sections, with the section near the clamping curving to the left in the drawing and the other bow section to the right. The magnets 25 are arranged at the start of the bow section curving to the right. Depending on design options, the magnets may also be set closer yet to the pressure bar 29.

Instead of solenoids, permanent magnets may also be used that are adjustable by means of the rods 37, contingent on a signal that measures the coating application or the profile. Controlled in the same contingency is also the current in the case of the solenoids.

It is also possible to make do without an adjustability of the pressure bar 29 that is contingent on a signal and apply the entire contact force of the doctor blade through the magnets. Since the various forces are generated then also only by various magnetic forces acting on the doctor blade and which in their level are not very different, it is given here also that the doctor blade will change only little in its shape and in the position of its spreading edge, in the profile adjustment.

Figure 4:
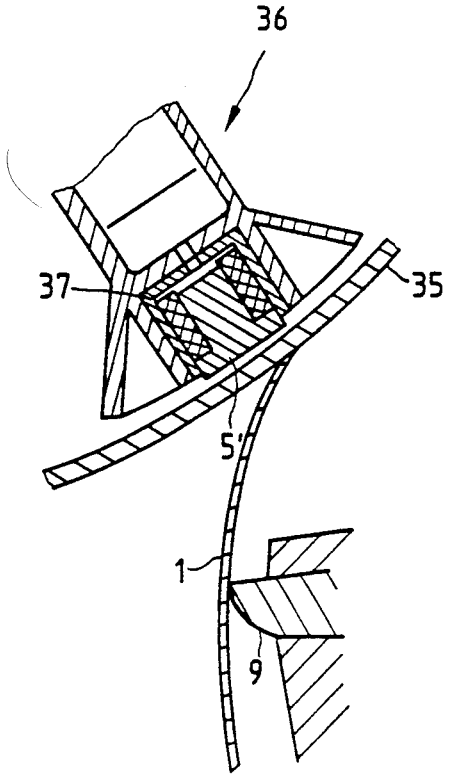
FIG. 4 shows another embodiment, wherein the magnetic traction forces act on the opposite side of the doctor blade in FIGS. 1–3.

Illustrated in FIG. 4 is another variant of the magnetic contact pressure. Alongside the support device 35 of the paper web designed as a hollow roll there is arranged here a carrier 36 that requires a very rigid design. It extends within the hollow roll 35 parallel to its axis and across its entire length. On its end facing toward the hollow roll shell it supports the magnets 5', which here in this case are illustrated as solenoids. In accordance with their magnetic induction, these magnets exert traction forces on the doctor 1, the same as in the case of FIG. 1, and are thus capable, in contingence on their activation, for instance by the coil current, to locally change the contact force of the doctor blade 1 on the hollow roll 35. This renders the coating profile also controllable. But this is the opposite direction as in the case of FIG. 1, namely in that the contact force is locally increased through the attraction force of the solenoids exerted on the doctor blade 1. In this case, the yoke support 36 is favorably made of high strength aluminum. However, it may also consist of steel, and the magnets can be insulated against the yoke support by means of insulating plates 37. The hollow roll 35 is preferably provided with a shell from nonmagnetic material.

The drain device 29 for the doctor blade is adjustable here, possibly also in a locally variable way, through pressure elements, for instance internally expanded pressure members. This support can be used also in the case of FIG. 1.

While this invention has been described as having a preferred design, the invention can be further modified within the spirit and scope of this disclosure. This application is therefore intended to cover any variations, uses or adaptations of the invention using its general principles. Further, this application is intended to cover such departures from the present disclosure as come within known or customary practice in the art to which this invention pertains and which fall within the limits of the appended claims.

What is claimed is:

1. A coating device for the coating of web material, comprising:

a doctor blade clamped and supported on a doctor beam by a clamping member, said doctor blade having a contact edge and acting on said web material at said contact edge with a contact force applied through a deflection of said doctor blade, an adjustable support member situated between said clamping member and said contact edge, said adjustable support member being adaptable to generate a bending force on said doctor blade to deflect said blade, said deflected doctor blade having a bowed portion generally adjacent said web, and a plurality of magnets arranged in a row on said doctor beam between said support member and said web and positioned generally parallel to said contact edge of said doctor blade, said magnets being adapted to apply magnetic traction forced for profile adjustment of a coating applied to said web, wherein said magnetic traction forces act on said bowed section of said doctor blade.

2. A coating device as described in claim 1, wherein said adjustable support member comprises a pressure bar, said pressure bar being arranged so as to be movable in a direction toward said web.

3. A coating device as described in claim 1, wherein said magnets are solenoids.

4. A coating device as described in claim 2, wherein said magnets are solenoids.

5. A coating device as described in claim 4, wherein said solenoids have an adjustable magnetic induction for effecting said profile adjustment.

6. A coating device as described in claim 1, wherein said magnets are permanent magnets.

7. A coating device as described in claim 2, wherein said magnets are permanent magnets.

8. A coating device as described in claim 1, wherein said magnets are arranged on said doctor beam so as to be adjustable transverse to said row arrangement of said magnets toward said doctor blade.

9. A coating device as described in claim 8, in which said magnets are arranged on slides, said slides being movable in a guideway of said doctor beam.

10. A coating device as described in claim 8, in which said doctor beam is connected to a holder part having a guideway disposed therein, wherein said magnets are arranged on slides, said slides being movable in said guideway.

11. A coating device as described in claim 1, wherein said support member comprises a rigid support bar.

12. A coating device as described in claim 2, wherein said pressure bar is a rigid support bar.

13. A coating device as described in claim 8, wherein said support member is a rigid support bar.

14. A coating device as described in claim 1, wherein said support member comprises a pressure hose.

15. A coating device as described in claim 2, wherein said support member comprises a pressure hose.

16. A coating device as described in claim 1, in which said web is supported by a backing roll in the area of said web, wherein said web is acted upon by said contact edge of said doctor blade, said backing roll being designed as a hollow roll having a yoke support arranged interiorly of said roll, said yoke support having a side adjacent to said hollow roll for supporting said magnets closely adjacent to said hollow roll.

* * * * *

UNITED STATES PATENT AND TRADEMARK OFFICE

CERTIFICATE OF CORRECTION

PATENT NO. : 5,085,168

DATED : February 4, 1992

INVENTOR(S) : Hans-Peter Sollinger

It is certified that error appears in the above-identified patent and that said Letters Patent is hereby corrected as shown below:

Claim 1, Column 5, Line 7, delete "forced" and substitute therefor --forces--.

Signed and Sealed this

Eleventh Day of May, 1993

*Attest:*

Michael K. Kirk

MICHAEL K. KIRK

*Attesting Officer*

*Acting Commissioner of Patents and Trademarks*